US007576044B2

(12) United States Patent
Doner

(10) Patent No.: US 7,576,044 B2
(45) Date of Patent: Aug. 18, 2009

(54) PAO OIL SELECTION TO CONTROL LUBRICATING GREASE EVAPORATION AND LOW TEMPERATURE

(75) Inventor: John Phillips Doner, Sewell, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 730 days.

(21) Appl. No.: 10/957,370

(22) Filed: Oct. 1, 2004

(65) Prior Publication Data

US 2006/0019843 A1 Jan. 26, 2006

Related U.S. Application Data

(60) Provisional application No. 60/519,926, filed on Nov. 14, 2003.

(51) Int. Cl.
*C10M 169/02* (2006.01)
*C10M 107/10* (2006.01)

(52) U.S. Cl. ..... 508/591; 508/519

(58) Field of Classification Search ..... 508/591
See application file for complete search history.

(56) References Cited

U.S. PATENT DOCUMENTS

| | | | | |
|---|---|---|---|---|
| 4,406,800 | A | 9/1983 | Christian | 252/28 |
| 4,879,054 | A | 11/1989 | Waynick | 252/41 |
| 5,089,156 | A * | 2/1992 | Chrisope et al. | 508/161 |
| 5,133,888 | A | 7/1992 | Waynick | 252/33.4 |
| 5,595,966 | A * | 1/1997 | Rees et al. | 508/591 |
| 5,728,659 | A | 3/1998 | Naka et al. | 508/552 |
| 6,313,077 | B1 | 11/2001 | Stunnenberg et al. | 508/591 |
| 6,432,889 | B1 * | 8/2002 | Kinoshita et al. | 508/399 |
| 6,667,281 | B2 * | 12/2003 | Ikejima et al. | 508/181 |
| 6,713,438 | B1 * | 3/2004 | Baillargeon et al. | 508/463 |
| 7,067,463 | B2 * | 6/2006 | Akiyama | 508/363 |
| 7,129,197 | B2 * | 10/2006 | Song et al. | 508/591 |

* cited by examiner

*Primary Examiner*—Ellen M McAvoy
(74) *Attorney, Agent, or Firm*—Mark Marin; Gary P Katz

(57) ABSTRACT

A grease composition comprising a base oil and a thickener that meets specified low temperature torque and high temperature evaporation requirements uses a base oil consisting essentially of a mixture of dimer, trimer, and higher oligomers of poly olefin wherein less than 10 wt % of the oligomer mixture is dimer.

14 Claims, No Drawings

PAO OIL SELECTION TO CONTROL LUBRICATING GREASE EVAPORATION AND LOW TEMPERATURE

This application claims the benefit of U.S. Ser. No. 60/519,926 filed Nov. 14, 2003.

FIELD OF INVENTION

The present invention relates to grease compositions. More particularly the invention relates to grease compositions employing olefin oligomers as the base oil in the grease.

BACKGROUND OF INVENTION

Lubricating greases contain three primary components: base oil, thickener and additives. The base oil provides lubricity, the thickener gives body and structure to the grease, and the additives increase resistance of the grease to oxidation, rust, corrosion and the like.

Conventionally base oils used in greases include mineral and synthetic oils and mixtures of each. Examples of mineral oils used are paraffinic and naphthenic oils. Examples of synthetic oils used are: esters including but not limited to polyol and dibasic acid esters, poly-glycols, synthetic hydrocarbons such as PAO (poly alpha olefins) and silicone oils.

A wide variety of materials are used as thickeners in lubricating greases, the selection of which often depends upon the application for the grease. Among the thickeners used in lubricating greases are intended soaps and complex soaps of these metals: aluminum, barium, calcium, iron, lead, lithium, magnesium, potassium, sodium, strontium, tin, titanium, zinc, or the following non-soap thickeners: calcium sulfonate, clay, pigments, polyurea, and polytetrafluoroethylene.

Additives that are used in greases include antioxidants, anticorrodants, metal deactivators, colorants and the like.

Greases are formulated with the view of meeting performance criteria based upon the intended use. For example, lubricating greases used in aviation applications are often required to have specific performance properties at both low and high temperatures. Among these properties are low temperature torque and high temperature evaporation. Low temperature torque is a measurement used to determine whether a grease is too firm such as to inhibit bearings from rotating freely at low temperatures. Good low temperature performance can be achieved by using an oil in the grease that is low in viscosity. The low temperature properties of a grease are typically measured using the ASTM method D 1478, Low Temperature Torque Of Ball Bearing Greases, which measures the freedom with which a ball bearing packed with grease operates when cooled to a specified temperature. The freedom of bearing rotation is reported by the D 1478 method, as the torque required to start and maintain rotation of the bearing. Torque is typically reported in units of Newton-meters.

One of the high temperature properties of a lubricating grease important to aviation applications is low evaporation. If the oil evaporates it is not available to lubricate and the performance of the grease lubricated component will be jeopardized. This is the case when aircraft lubricants are exposed to high temperatures as well as reduced atmospheric pressure when operating during flight. Both conditions can promote the evaporation of the oil used in the grease. An approach for avoiding excessive evaporation is to use greases with high base oil viscosity. Tests typically used to measure the evaporation loss of lubricating grease are the ASTM test methods D 972, and D 2595, Evaporation Loss Of Lubricating Greases. In each of these tests heated air passes over the surface of the grease for a specified time with the air heated to a specified temperature as called for by the aviation grease specification.

One particular specification, Boeing Material Specification, BMS 3-33A, Grease, Aircraft, General Purpose, calls for a grease in which the low temperature starting torque in the ASTM D 1478 test shall not exceed 0.10 Newton-meter and in which the evaporation weight loss of the grease, when evaluated in the ASTM D 2595 test for 500 hours at 121° C. shall not exceed 10.0 wt %.

When the type of oil selected for a grease to meet the Boeing Material Specification, BMS 3-33A is 100% poly alpha olefin (PAO), experience has shown that difficulty is encountered because the low viscosity PAO needed to meet the low temperature torque requirements results in excessive high temperature evaporation. One approach to overcome this difficulty is to use PAO blends with synthetic esters as the grease base oil; however, esters may hydrolyze in hot and wet environments and produce species that may be corrosive to various metals. Therefore it would be desirable to provide a grease having a PAO base oil that is free of polyesters and that can meet the Boeing specification.

SUMMARY OF INVENTION

Broadly stated, the present invention relates to a grease composition comprising a major portion of an oil of lubricating viscosity and a minor portion of a grease thickener sufficient to thicken the oil to grease consistency wherein the oil of lubricating viscosity consists essentially of a mixture of dimer, trimer and higher oligomers of poly alpha olefins, poly internal olefins and mixtures thereof in which the oligomer mixture contains less than 10 wt % of dimer.

DETAILED DESCRIPTION OF INVENTION

The base oil used in the present invention is a mixture of dimers, trimers and higher oligomers of poly alpha olefins, poly internal olefin and mixtures thereof. Preferably the base oil is a mixture of PAO oils derived from linear alpha olefins that have been polymerized and additionally hydrogenated to remove unsaturated double bonds and that have been fractionated to obtain a particular product slate. PAO's have numbers assigned to them to indicate the approximate viscosity in centistokes at 100° C. In Table 1 there is shown the segment distribution for a number of PAO oils derived from 1-decene. Segments containing 20 carbons are dimers, 30 carbons are trimers and 40 carbons are tetramers, for example. In the present invention the PAO oligomers preferably are derived from alpha olefins having from about 5 to about 14 carbon atoms. Indeed 1-decene is especially preferred alpha olefin used in forming the oligomers. Additionally it is preferred that the base oil have a viscosity not greater than 25 cSt at 40° C. For example, a mixture of base PAO oils having a viscosity in the range of about 13 cSt to about 20 cSt at 40° C. would be suitable for use in the present invention.

TABLE 1

Viscosity & Composition of PAO Oils

| PAO Oil: | 2 cSt-1 | 4 cSt-1 | 4 cSt-2 | 4 cSt-3 |
|---|---|---|---|---|
| Viscosity @ 40 C., cSt | 5.22 | 15.19 | 16.84 | 17.85 |
| Viscosity @ 100 C., cSt | 1.73 | 3.57 | 3.82 | 4.02 |

TABLE 1-continued

| Wt % PAO Oligomer Segments | | | | |
|---|---|---|---|---|
| C 20 | 98.64 | 0.07 | 0.06 | 0.58 |
| C 30 | 1.18 | 99.34 | 87.66 | 79.63 |
| C 40 | 0.14 | 0.59 | 11.81 | 17.8 |
| C 50 | 0.04 | 0.00 | 0.47 | 1.99 |

In order to meet the low temperature torque and high temperature evaporation requirements of Boeing specification BMS 3-33A the base poly-olefin oligomer oil used in formulating the grease will contain less than 10 wt % dimer, for example, from 5 wt % to 10 wt %. Typically the oil also will contain greater than about 75 wt % trimer, for example, from 75 wt % to about 95 wt %.

The base oil will comprise a major amount of the grease composition, for example, from about 65 wt % to about 80 wt % based on the total weight of the grease.

The grease also comprises a minor amount of a thickener sufficient to thicken the oil to grease consistency. Typically the thickener will comprise about 5 wt % to about 20 wt % of the grease.

Suitable thickeners include soap thickeners and non-soap thickeners. Examples of soap thickeners include soaps of lithium, sodium, calcium, barium, aluminum, zinc and the like. Examples of non-soap thickeners include calcium sulfonate, clay, silica gel, urea compounds and the like.

The composition of the invention may also include minor but effective amounts of other grease additives including antioxidants, anticorrodants, metal deactivators, rust inhibitors, extreme pressure agents, colorants, and the like.

The compositions are prepared in conventional grease blending equipment by manufacturing the thickener at temperatures up to about 150° C. to 200° C. and thoroughly mixing in the additives at temperatures generally from 35° C. to about 100° C.

The invention will be further illustrated by the following examples.

EXAMPLE 1

Three PAO blends were made from various combinations of the PAO oils listed in Table 1. The composition of the three blends is given in Table 2.

Each of the three PAO oil blends were then formed into a grease using approximately 9 wt % (based on 12-hydroxy stearic acid) of lithium complex thickener and approximately 17% additives consisting of typical corrosion inhibitors, anti-wear agents, extended pressure agents and antioxidants. The resulting greases were then subjected to ASTM tests D1478 and D2595. The results of the test also are shown in Table 2.

TABLE 2

| | Blend No.: | | |
|---|---|---|---|
| | 1 | 2 | 2 |
| Blends of PAO Oils Listed in Table 2 | | | |
| % PAO 2 cSt-1 | 26 | 10 | 7 |
| % PAO 4 cSt-1 | | 90 | |
| % PAO 4 cSt-2 | | | 93 |
| % PAO 4 cSt-3 | 74 | | |
| Blend's PAO Oligomer Segment Content, Weight % | | | |
| C20 | 26.08 | 9.93 | 6.96 |
| C30 | 59.23 | 89.52 | 81.61 |

TABLE 2-continued

| | Blend No.: | | |
|---|---|---|---|
| | 1 | 2 | 2 |
| C40 | 13.21 | 0.55 | 10.99 |
| C50 | 1.48 | 0.00 | 0.44 |
| PAO Blend's Viscosity, cSt | | | |
| 40° C. | 12.53 | 13.50 | 15.05 |
| 100° C. | 3.16 | 3.31 | 3.56 |
| Properties of Greases Made with PAO Oil Blends 1, 2 and 3 | | | |
| Low Temperature Torque @ −73° C., Newton-meters (1) | | | |
| Starting | 0.69 | 0.65 | 0.54 |
| Running | 0.08 | 0.09 | 0.075 |
| Evaporation, 500 hours @ 121° C., Weight % Loss (2) | | | |
| | 21.39 | 10.77 | 8.7 |

(1) BMS 3-33 A Requires: 0.75 starting maximum and 0.10 running maximum
(2) BMS 3-33 A Requires 10% maximum As can be seen oil blend 1 meets the low temperature torque requirements of BMS 3-33A but not the evaporation requirement. The data also shows that as the dimer amount is reduced the high temperature evaporation property is improved.

What is claimed is:

1. A grease composition comprising a major portion of an oil of lubricating viscosity and a minor portion of a grease thickener sufficient to thicken the oil to grease consistency wherein the oil of lubricating viscosity consists essentially of a mixture of dimer, trimer and higher oligomers of poly alpha olefin oils, poly internal olefin oils and mixtures thereof in which the oligomer mixture olefins contains greater than 75 wt % trimer and less than 10 wt % are dimers.

2. The composition of claim 1 wherein the oil consists essentially of a mixture of oligomers of poly alpha olefins derived from alpha olefins having about 5 to about 14 carbon atoms.

3. The composition of claim 2 wherein the thickener comprises from about 5 wt % to about 20 wt % based on the total weight of the composition.

4. The composition of claim 3 wherein the thickener is selected from the group consisting of soap thickeners and non-soap thickeners.

5. The composition of claim 4 wherein the thickener is a soap thickener.

6. The composition of claim 5 wherein the soap thickener is a complex lithium soap.

7. A grease composition having as determined by ASTM D1478, a low temperature starting torque not to exceed 0.75 Newton-meter and a low temperature torque after 60 minutes not to exceed 0.10 Newton-Meter, and having, as determined by ASTM D2595, an evaporation weight loss after 500 hours at 121° C. not to exceed 10 wt % which grease comprises:

a major amount of a base oil of lubricating viscosity, a minor amount of a grease thickener sufficient to thicken the oil to grease consistency, wherein the oil of lubricating viscosity consists essentially of a mixture of dimer, trimer and higher oligomers of poly alpha olefin oils having a viscosity not greater than 25 cSt at 40° C. and contains greater than 75 wt % trimer and less than 10 wt % dimer.

8. The composition of claim 7 wherein the oil contains from 5 to 10 wt % dimer and from 75 wt % to 95 wt % trimer, the balance being higher oligomers.

9. The composition of claim 8 wherein the poly alpha olefin oil is derived from alpha olefins having from about 5 to about 14 carbon atoms.

10. The composition of claim 9 wherein the alpha olefin has 10 carbon atoms.

11. A grease composition comprising:

a major amount of an oil having a viscosity not greater than 25 cSt at 40° C. and consisting essentially of a mixture of dimer, trimer and higher oligomers of poly alpha olefins having less than about 10 wt % to about 5 wt % dimer and greater than about 75 wt % to 95 wt % trimer, the balance being higher oligomers; and a minor amount of a grease thickener sufficient to thicken the oil to grease consistency, whereby the grease has a low temperature starting torque not exceeding 0.75 Newton-meter and a low temperature torque after 60 minutes not exceeding 0.10 Newton-meter, each determined by ASTM D1478, and an ASTM D2595 evaporation weight loss after 500 hrs at 121° C. not to exceed 10 wt %.

12. The composition of claim 11 wherein the thickener is lithium complex and comprises 5 to 20 wt % of the composition.

13. The compositions as in any one of claims 1, 7, and 11 wherein the oil has a viscosity not greater than 3.31 cSt at 100° C.

14. The composition of claim 2 wherein the oil has a viscosity not greater than 25 cSt at 40° C.

* * * * *